US011939704B2

(12) United States Patent
Hu et al.

(10) Patent No.: US 11,939,704 B2
(45) Date of Patent: Mar. 26, 2024

(54) WATER-RESPONSIVE SHAPE MEMORY WOOL FIBER, FABRIC AND TEXTILE COMPRISING THEREOF, AND METHOD FOR PREPARING THE SAME

(71) Applicants: City University of Hong Kong, Hong Kong (HK); The Hong Kong Polytechnic University, Hong Kong (HK)

(72) Inventors: Jinlian Hu, Hong Kong (HK); Mohammad Irfan Iqbal, Hong Kong (HK)

(73) Assignees: City University of Hong Kong, Hong Kong (HK); The Hong Kong Polytechnic University, Hong Kong (HK)

( * ) Notice: Subject to any disclaimer, the term of this patent is extended or adjusted under 35 U.S.C. 154(b) by 106 days.

(21) Appl. No.: 17/503,401

(22) Filed: Oct. 18, 2021

(65) Prior Publication Data

US 2022/0119990 A1 Apr. 21, 2022

Related U.S. Application Data

(60) Provisional application No. 63/093,365, filed on Oct. 19, 2020.

(51) Int. Cl.
*D02G 1/02* (2006.01)
*D02G 3/26* (2006.01)

(52) U.S. Cl.
CPC ..... *D02G 1/0293* (2013.01); *D02G 3/26* (2013.01); *D10B 2211/02* (2013.01);
(Continued)

(58) Field of Classification Search
CPC ..... D10B 2211/02; D10B 2401/02; D10B 2401/046; D02G 1/00; D02G 1/0293; D02G 3/26; D02G 3/28
See application file for complete search history.

(56) References Cited

U.S. PATENT DOCUMENTS 2,296,329 A * 9/1942 Smith ..... D02G 1/18 28/240
3,458,987 A * 8/1969 Adachi ..... D02G 3/38 57/328

(Continued)

FOREIGN PATENT DOCUMENTS

CN 101096424 A 1/2008
CN 101298490 A 11/2008

(Continued)

OTHER PUBLICATIONS

English translation of JP2000008233 to Futamara, accessed via espacenet.com (last visited Jun. 7, 2023). (Year: 2023).*

(Continued)

*Primary Examiner* — Patrick J. Lynch
(74) *Attorney, Agent, or Firm* — Idea Intellectual Limited; Margaret A. Burke; Sam T. Yip

(57) ABSTRACT

A woven, water-vapor permeable, water-responsive, shape-memory wool fabric that possesses switchable pore size and shape responsive to varying water content absorbed thereby is demonstrated, more particularly, the wool fabric exerts corresponding thermal and water vapor regulations between the wearer and the surroundings with respect to the temperature and humidity changes.

14 Claims, 11 Drawing Sheets

(52) U.S. Cl.
CPC .... *D10B 2401/02* (2013.01); *D10B 2401/046* (2013.01); *D10B 2501/04* (2013.01)

(56) References Cited

U.S. PATENT DOCUMENTS

| | | | | |
|---|---|---|---|---|
| 3,831,368 | A * | 8/1974 | Glowacki | D02G 3/445 57/239 |
| 6,523,196 | B1 * | 2/2003 | Kuno | D06C 23/04 5/482 |
| 7,858,055 | B2 * | 12/2010 | Lee | B29C 44/357 422/199 |
| 8,187,984 | B2 | 5/2012 | Rock | |
| 8,192,824 | B2 | 6/2012 | Rock et al. | |
| 8,389,100 | B2 | 3/2013 | Rock et al. | |
| 8,658,943 | B1 | 2/2014 | Larsen et al. | |
| 8,907,251 | B2 | 12/2014 | Larsen et al. | |
| 9,982,661 | B1 | 5/2018 | Trigwell et al. | |
| 2006/0272358 | A1 * | 12/2006 | Morita | D04B 15/50 66/238 |
| 2008/0057809 | A1 | 3/2008 | Rock | |
| 2013/0045653 | A1 * | 2/2013 | Takahashi | D03D 15/513 428/221 |
| 2013/0078415 | A1 | 3/2013 | Rock | |
| 2017/0096520 | A1 * | 4/2017 | Chen | C08G 18/87 |
| 2018/0195213 | A1 * | 7/2018 | Tibbits | D03D 15/567 |
| 2019/0203389 | A1 * | 7/2019 | Liu | A43B 1/04 |
| 2020/0002855 | A1 * | 1/2020 | Aristizabal | D04B 1/22 |
| 2020/0131675 | A1 * | 4/2020 | Bhatnagar | D02G 3/442 |
| 2020/0181815 | A1 * | 6/2020 | Zhang | A41B 11/14 |
| 2021/0324539 | A1 * | 10/2021 | Cera | D01D 5/06 |
| 2022/0119990 | A1 * | 4/2022 | Hu | D02G 3/26 |
| 2023/0002937 | A1 * | 1/2023 | Granberry | D02G 3/441 |

FOREIGN PATENT DOCUMENTS

| | | | | |
|---|---|---|---|---|
| CN | 101709197 | A | 5/2010 | |
| CN | 102181066 | A | 9/2011 | |
| CN | 102797159 | A | 11/2012 | |
| CN | 104193893 | A | 12/2014 | |
| CN | 104403086 | A | 3/2015 | |
| CN | 105860019 | A | 8/2016 | |
| CN | 107189006 | A | 9/2017 | |
| CN | 112111842 | A * | 12/2020 | C08B 31/00 |
| IN | 102845841 | A | 1/2013 | |
| JP | 07300771 | A * | 11/1995 | |
| JP | 2000008233 | A * | 1/2000 | |
| JP | 3838392 | B2 * | 10/2006 | |

OTHER PUBLICATIONS

Hu et al., Wool Can be Cool: Water-Actuating Woolen Knitwear for Both Hot and Cold, Sep. 16, 2020, Adv. Funct. Mater. (Year: 2020).*

X. A. Zhang et al., Dynamic gating of infrared radiation in a textile. Science, 363, 619-623 (2019).

P.-C. Hsu et al., A dual-mode textile for human body radiative heating and cooling. Science advances, 3, e1700895 (2017).

K. Panwar, M. Jassal, A. K. J. S. Agrawal, C. Technology, TiO2-SiO2 Janus particles treated cotton fabric for thermal regulation. Surface and Coatings Technology,309, 897-903 (2017).

T. Gao et al., Three-dimensional printed thermal regulation textiles. ACS nano, 11, 11513-11520 (2017).

J. K. Tong et al., Infrared-transparent visible-opaque fabrics for wearable personal thermal management. ACS Photonics, 2, 769-778 (2015).

S. Jafar-Zanjani, M. M. Salary, H. J. A. P. Mosallaei, Metafabrics for thermoregulation and energy-harvesting applications. ACS Photonics, 4, 915-927 (2017).

P.-C. Hsu et al., Radiative human body cooling by nanoporous polyethylene textile. Science, 353(6303) 353, 1019-1023 (2016).

P.-C. Hsu et al., Personal thermal management by metallic nanowire-coated textile. Nano letters, 15, 365-371 (2014).

A. Nejman, M. J. A. T. E. Cieslak, The impact of the heating/cooling rate on the thermoregulating properties of textile materials modified with PCM microcapsules. Applied Thermal Engineering, 127, 212-223 (2017).

P. Sanchez, M. V. Sanchez-Fernandez, A. Romero, J. F. Rodriguez, L. J. T. A. Sanchez-Silva, Development of thermo-regulating textiles using paraffin wax microcapsules. Thermochimica Acta, 498, 16-21 (2010).

A. G. Hassabo, A. L. J. C. p. Mohamed, Enhancement the thermo-regulating property of cellulosic fabric using encapsulated paraffins in modified pectin. Carbohydrate polymers, 165, 421-428 (2017).

Y. X. Cui, thesis, Carleton University, (2012).

P. B. Catrysse, A. Y. Song, S. J. A. P. Fan, Photonic structure textile design for localized thermal cooling based on a fiber blending scheme. ACS Photonics, 3, 2420-2426 (2016).

L. Cai et al., Spectrally selective nanocomposite textile for outdoor personal cooling. Advanced Materials, 30, 1802152 (2018).

T. Guo, B. Shang, B. Duan, X. J. J. o. t. b. Luo, Design and testing of a liquid cooled garment for hot environments. Journal of thermal biology, 49, 47-54 (2015).

R. Bagherzadeh et al., Evolution of moisture management behavior of high-wicking 3D warp knitted spacer fabrics. Fibers and Polymers, 13, 529-534 (2012).

L. Zhu, M. Naebe, I. Blanchonette, X. J. T. r. j. Wang, Moisture transfer properties of bifacial fabrics. Textile research Journal, 87, 1096-1106 (2017).

Y. Guo et al., Fluoroalkylsilane-modified textile-based personal energy management device for multifunctional wearable applications. ACS applied materials & interfaces, 8, 4676-4683 (2016).

Y. Zhai et al., Scalable-manufactured randomized glass-polymer hybrid metamaterial for daytime radiative cooling. Science, 355(6329)355, 1062-1066 (2017).

Y. Peng et al., Nanoporous polyethylene microfibres for large-scale radiative cooling fabric. Nature Sustainability, 1, 105 (2018).

W. Li, Y. Zhao, X. J. J. o. T. B. Wang, Effect of surface modification on the dynamic heat and mass transfer of wool fabrics. Journal of Thermal Biology, 102416 (2019).

Wang, W., et al., Harnessing the hygroscopic and biofluorescent behaviors of genetically tractable microbial cells to design biohybrid wearables. Science advances, 2017. 3(5): p. e1601984.

Yue, X., et al., A laminated fibrous membrane inspired by polar bear pelt for outdoor personal radiation management. ACS Applied Materials & Interfaces, 2020.

Liu, K., et al., Facile fabrication of environmental-friendly waterproof and breathable nanofibrous membranes with high UV resistance performance by one-step electrospinning. Industrial & Engineering Chemistry Research, 2020.

Van Langenhove, L., R. Puers, and D. Matthys, Intelligent textiles for protection. Textiles for protection, 2005:p. 176-195.

Y.Zhong et al., Reversible humidity sensitive clothing for personal thermoregulation.Scientific reports, 7, 44208 (2017).

A. Kulkarni, A. Tourrette, M. M. Warmoeskerken, D. J. C. P. Jocic, Microgel-based surface modifying system for stimuli-responsive functional finishing of cotton.Carbohydrate Polymers, 82, 1306-1314 (2010).

P. K. Lavrič, M. M. Warmoeskerken, D. J. C. Jocic, Functionalization of cotton with poly-NiPAAm/chitosan microgel. Part I. Stimuli-responsive moisture management properties. Cellulose, 19, 257-271 (2012).

W. Wang, W. J. C. p. Yu, Preparation and characterization of CS-g-PNIPAAm microgels and application in a water vapour-permeable fabric. Carbohydrate polymers, 127, 11-18 (2015).

N. K. Memiş, S. J. T. J. o. T. T. I. Kaplan, Wool fabric having thermal comfort management function via shape memory polyurethane finishing. The Journal of The Textile Institute, 1-11 (2019).

K. Xiao, J. Hu, X. Gui, J. Lu, H. Luo, Is biopolymer hair a multi-responsive smart material? Polymer Chemistry 8, 283-294 (2017).

T. Townsend, J. Sette, "Natural Fibres: Advances in Science and Technology Towards Industrial Applications." in Natural Fibres and the World Economy (Springer, Dordrecht, 2016), pp. 381-390.

(56) References Cited

OTHER PUBLICATIONS

X. Xiao, J. Hu, X. Gui, K. Qian, Shape memory investigation of α-keratin fibers as multi-coupled stimuli of responsive smart materials. Polymers 9, 87 (2017).
X. Xiao, J. Hu, Animal hairs as water-stimulated shape memory materials: mechanism and structural networks in molecular assemblies. Scientific reports 6, 26393 (2016).
L. Wang, A. Cavaco-Paulo, B. Xu, M. Martins, Humidity Induces Changes in the Dimensions of Hydrogel-Coated Wool Yarns. Polymers 10, 260 (2018).
L. J. M. T. Ionov, Hydrogel-based actuators: possibilities and limitations. Ionov, L. (2014). Hydrogel-based actuators: possibilities and limitations. Materials Today, 17, 494-503 (2014).
B. C. Smith, "The Basics of Infrared Interpretation, Infrared spectral interpretation." (CRC Press, 2018), pp. 17-46.
V. Apostolopoulou-Kalkavoura, K. Gordeyeva, N. Lavoine, L. J. C. Bergstrom, Thermal conductivity of hygroscopic foams based on cellulose nanofibrils and a nonionic polyoxamer. Cellulose, 25, 1117-1126 (2018).
E. Pakdel, M. Naebe, L. Sun, X. J. A. a. m. Wang,Advanced functional fibrous materials for enhanced thermoregulating performance. ACS applied materials & interfaces, 11, 13039-13057 (2019).
A. F. Handbook, American society of heating, refrigerating and air-conditioning engineers. Inc .: Atlanta, GA, USA, (2009).
S. Thakur, M. A. Jahid, J. J. P. I. Hu, Mechanically strong shape memory polyurethane for water vapour permeable membranes. Polymer International, 67, 1386-1392 (2018).

* cited by examiner

WATER-RESPONSIVE SHAPE MEMORY WOOL FIBER, FABRIC AND TEXTILE COMPRISING THEREOF, AND METHOD FOR PREPARING THE SAME

CROSS-REFERENCE WITH RELATED APPLICATIONS

The present application claims priority from the U.S. Provisional Patent Application No. 63/093,365 filed Oct. 19, 2020, and the disclosure of which is incorporated herein by reference in its entirety.

FIELD OF THE INVENTION

The present invention relates to water-responsive, shape-memory natural fiber, yarn, fabric and textile comprising thereof with pore actuating function, and method for preparing the same.

BACKGROUND

Human body is sensitive to temperature and humidity. Subject to environmental change and activity needs, one can have no sweat, sweat slightly or heavily to keep body temperature constant, called thermoregulation. Human skin is one of natural thermoregulators responsive to the external environmental changes and also internal changes. However, in extreme weather conditions or with special needs, human being may require an additional thermoregulating means to mitigate the negative impacts on heat exchange and water evaporation/permeability from temperature and/or humidity fluctuations arising from the extreme environmental conditions and/or rapid changes of body temperature of a subject.

As human civilization evolves, clothes are not just for protection, aesthetics and courtesy, but also made in different structures and/or of different materials for different situations/applications to accommodate needs for additional body thermoregulation. However, under some circumstances, it is very important to have an all-condition garment to adapt different circumstances where hot and cold weathers switch inevitably. To achieve reasonable comfort and maximal safety under such cases like heavy exercise in winter, a number of properties need to be controlled for a textile fabric in terms of water vapor permeability, thermal conductivity, air permeability and infrared radiation.

One of the most important functions of textiles used as clothing is to provide a comfortable environment for the body with a balance of heat and moisture. It is required to absorb or take away the moisture and sweat discharged by the body to keep the body dry. It also depends on the static air in the fiber gaps of the fabric. Air acts as a heat-insulating medium to maintain a suitable temperature for the human body to keep warm.

Body heat dissipation can be roughly divided into conduction, convection, radiation and evaporation, of which radiation accounts for about 60%. When the ambient temperature increases or the body temperature increases after exercise, the sweat glands on the skin will discharge sweat. When the sweat evaporates, it will take away a large amount of heat energy to achieve the purpose of heat dissipation. However, if a large amount of sweat accumulates on the skin, it will cause discomfort to the body. Traditionally, animal fibers such as wool, rabbit hair or camel hair are curly in fiber shape, and fabrics can provide good thermal insulation, so they are generally only used in winter clothing, and seldom used in summer clothing. With the development of global warming, because of its warmth retention, the consumption growth of its wool fabrics has declining day by day. However, animal fiber has good biodegradability. Generally, it takes about half a year for animal fiber to degrade in soil. Compared with other man-made fibers, it has a lower environmental impact and is a sustainable fiber. Zhang et al. (2017) mentioned in the "Analysis of the Degradation Characteristics of Cellulose and Protein Fibers" published in the Chinese Journal of Textile and Apparel" that when the landfill time reaches 6 months, wool is integrated with the soil. Also, sports have become a fashion and necessities of health care. It needs to change from a static warm state to heat and sweat, so it can be adjusted with the ambient temperature and the amount of exercise. The warm and cool wool fabric has important environmental protection, business and maintenance. The meaning of good health.

To meet the afore-mentioned demands, different approaches had been proposed for developing thermoregulating textiles. In 1990s, Defense Clothing & Textiles Agency of UK Army used SMMs and its derivatives for heat-protective clothing. In that study, based on tunable air gap, thermo-responsive shape memory alloy (Nitinol) based springs were incorporated into cotton fabrics with bilayer structure, whose thickness could be changed due to the conical spring contraction and expansion with ambient temperature variation, subsequently offering thermoregulatory effect. However, the repeatability of those springs was very poor and sometimes required an external mechanical force to support.

In another study, a humidity sensitive SMM sheet (Nafion) was laminated into a clothing fabric, capable to show quick response to change of sweat of a human body for heat and mass transfer. Such approaches, however, were not suitable for large scale production with high cost and not sustainable due to toxicity of the chemicals.

Temperature-sensitive hydrogels of poly-NiPAAm and chitosan were applied to surface modification of cotton fabrics for thermal management, which may help regulate water vapor permeability or water uptake under ambient temperature variation due to the contraction/expansion behavior of thermo-responsiveness of hydrogels.

Another attempt was to coat a woven wool fabric with shape memory polyurethane (SMPU) solution for thermal management. This kind of coating and finishing surface modification technology in fact has the problem of processability, poor hand feeling, washability and sustainability.

Wool as a keratinous protein animal hair is mainly considered for natural warmth and thermal insulator. Therefore, it is only used for clothing in winter and hence loses its demand in fiber market continuously as global warming evolves. Research to date has not yet determined the synergistic water driven shape memory effect of pure wool yarn and their fabrics.

Overcoming current drawbacks and meeting practical needs for sustainable thermoregulatory textiles, here, a yarn with descaled pure wool fiber to make a knit fabric is needed. It should have characteristics/functions such as adaptive thermoregulation in terms of water vapor permeability, thermal conductivity, air permeability and infrared radiation, under various sweat levels. Against intuition and worldwide public and professional knowledge, it is enchanting to see that wool can be cool when sweating. Such fabric should also have a shape memory effect (SME) where water switches knit pores (open/close) and allows a wearer feels warm when there is no/less sweat and cool when sweats in active exercising and summer. There is also needed a method for preparing such a fabric that is applicable to a wide variety of fibers including natural (e.g., animal) fibers as smart materials and wool as a clothing material for all over the year and in all situations with/without exercising.

SUMMARY OF THE INVENTION

To address the shortcomings in the prior arts, a first aspect of the present invention provides a shape memory, natural wool fabric with a specific temperature adjustment function. More specifically, the present invention provides a shape-memory animal wool fabric with smart pore actuation ability for temperature regulation function. Initially, the present shape-memory animal wool fabric is formed from spinning a plurality of treated wool fibers with low to medium twist to become a plurality of twisted wool fibers or yarns. The yarns are thereby formed with a water-responsive shape memory function, that is, the length of the yarn increases while the diameter thereof decreases when the degree of water absorption by the yarn increases; when the water content absorbed by the yarns decreases to a sufficient level, the yarns return to its original shape. When the present yarns are made into a fabric, a porous water-actuating wool fabric is resulted. A plurality of pores is incorporated into the fabric network during formation thereof from the yarns. The water-actuation effect of the fabric is provided by increasing the number of pores when the fabric is exposed to moisture. The increase in the number of pores reduces thermal insulation performance of the fabric, thereby accelerating heat dissipation of the wearer's body. On the other hand, the fabric returns to its thermal insulation state when the moisture content in the fabric decreases, in order to achieve thermoregulation.

In one embodiment, the wool fibers are treated to remove surface scales (or descaled). The wool fibers are descaled by ultrasonic treatment in a solution of sodium hypochlorite, hydrochloric acid and nano-calcium carbonate.

In a specific embodiment, the ultrasonic treatment is performed in an ultrasonic bath containing 5 g/l of sodium hypochlorite, 1 g/l of hydrochloric acid, and 10 g/l of nano-calcium carbonate. The fabric is immersed into the ultrasonic bath at 37° C. for 45 mins.

In another embodiment, the yarns are prepared by making the plurality of wool fibers in a combed or carded manner.

In a specific embodiment, the plurality of wool fibers is twisted by spinning including ring spinning and alike to form yarn, wherein the spinning twist is from 100 to 600 twists per meter of wool fiber strand.

In a preferred embodiment, the spinning twist of the wool fibers is at 200 to 400 twists per meter.

In other embodiment, a plurality of yarns is twisted at 200 to 700 twists per meter.

In a specific embodiment, two to five single yarns are twisted at a frequency of 400-600 twists per meter so that 2- to 5-ply yarns are formed.

In one embodiment, the plied yarns are further set by steaming for a first period of time followed by heating to a temperature for a second period of time.

In a specific embodiment, the first period of time for steaming the plied yarns is approximately 10 to 90 minutes.

In another specific embodiment, the second period of time for heating the plied yarns after steaming is approximately 10 to 90 minutes and the temperature of heating the plied yarns after the steaming is up to about 105° C. in an oven.

A second aspect of the present invention provides a method of preparing a textile from the fiber, yarn and fabrics described in the first aspect of the present invention. The method includes:

descaling surface scales of the plurality of natural fibers by chlorination under ultrasound;

combing or carding the plurality of natural fibers after said descaling;

twisting the plurality of natural fibers at a frequency of 100 to 600 twists per meter of the fibers to yield a plurality of single yarns;

twisting a plurality of single yarns each time at a frequency of 200 to 700 twists per meter of the single yarns to yield a plurality of plied yarns;

setting the plurality of plied yarns by steaming followed by drying;

knitting the plurality of plied yarns according to a knitting pattern to yield a fabric with the knitting pattern having a plurality of pores capable of actuating according to water absorbed by the fabric, and variable fiber and yarn diameter and length subject to the level of water absorbed by the fabric and changes in surface temperature of the fabric.

In one embodiment, the plurality of natural fibers is ring spun at 200 to 400 twists per meter after said combining or carding.

In one embodiment, the plurality of single yarns are two to five single yarns being twisted by plying at 400 to 600 twists per meter.

In one embodiment, the setting of the plied yarns by steaming is for about 10 to 90 minutes following by said drying at about 105° C. for about 10 to 90 minutes in an oven.

A textile including, but not limited to, a knitwear with pore actuation function responsive to water content changes which is prepared according to the present fibers, yarns and method described herein is also one of the aspects of the present invention.

Although the various embodiments of the present invention are described based on without undue experimentation and departure from the spirit and objectives of the present invention.

BRIEF DESCRIPTION OF THE DRAWINGS

Embodiments of the invention are described in more details hereinafter with reference to the drawings, in which.

DEFINITIONS

Figure 1:
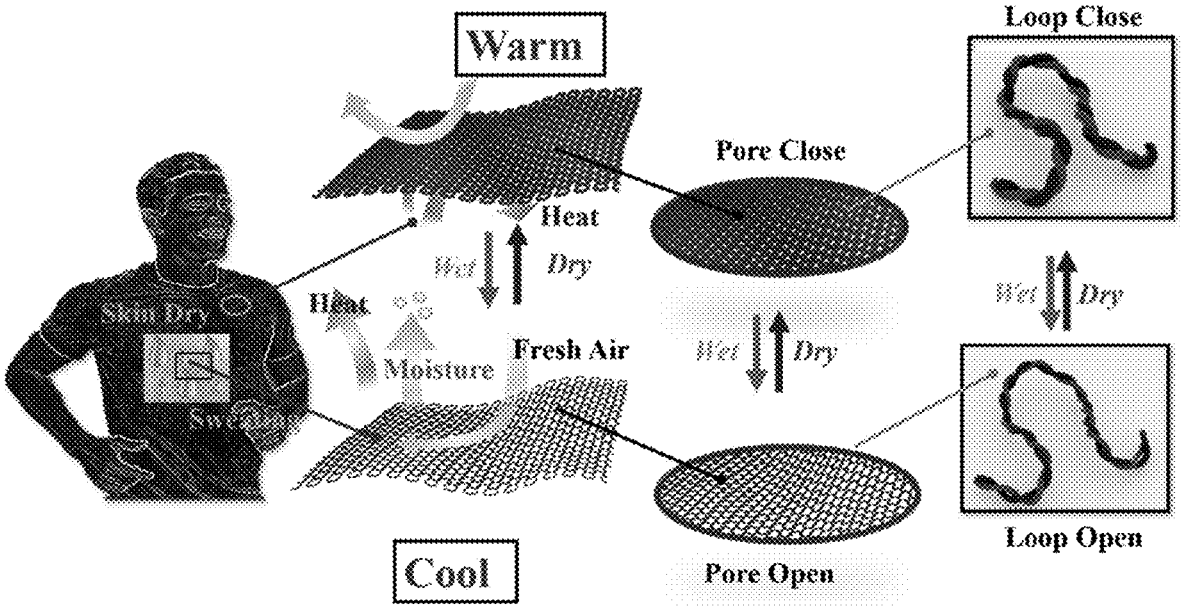
FIG. 1 schematically depicts effect of shape memory fabric of the present invention on thermoregulation of wearer's body.

"mass per unit area" and "thickness" of fabric are determined by some standardized test procedures including respectively, but not limited to, ASTM D3776/D3776M-09ae2 (2009) and ASTM D1777-96e1 (2011). Some sample thicknesses are measured by an SDL thickness gauge. In addition, a scanning electron microscope (JSM-6510LV, voltage: 20 kV) and a light microscope (LEICA M165 C) are used to investigate the surface morphology and the fibers, yarns and fabric images, respectively.

Effect of water on molecular vibration due to dipole moment change is identified by ATR-FTIR (The Bruker Veertex-70) analysis on dry and wet samples. The test is conducted in the range of 400-4000 $cm^{-1}$ with a 16 scan numbers.

"Elastic modulus" of each of the natural fibers described herein is measured by using Instron 4411 Universal Testing Instrument. Briefly, the natural fiber, e.g., wool fiber, is attached on a paper template with a 3 cm window. The tests are carried out under standard testing environment (20° C., 65% RH) with a crosshead speed 100 mm/min. For each of dry and wet conditions, 20 samples are considered randomly, and their average elastic modulus values are obtained.

Shape memory effect (SME) described herein with respect to the yarn is qualitatively and also quantitatively assessed by taking single fibers from an as-prepared yarn of the fabric using tweezer and soaked in water at 20° C. for 1 hour to ensure the full interaction with water. Finally, the shape change and recovery behavior of fibers were captured and observed through a commercial camera. The SME of wool yarns was measured in terms of length and diameter changes triggered by water. The conditioned yarn packages were transformed to 1 lea of skein (10 meters in length) by wrap reel method in order to enhance accuracy in measurement of length and diameter change of the yarns stimulated with water and relaxation was done on the skein before marking. After that the skein was oven dried at 105° C. for 1 hour. Thereafter immediately the length and diameter of dried yarns were recorded by a light microscope and immersed in water at 20° C. for 1 hour in order to measure the change in length and diameter of the corresponding yarn in water. Subsequently, the yarns are taken out of water and excess water is removed by hydroextractor. Finally, the yarn's shape changes including length and diameter are recorded in wet using a light microscope and examined by image analysis software (Image J). Likewise, for characterizing fabric's SME, the samples are treated with water according to the procedure for studying yarns with a conditioned fabric sample size 10*10 $cm^2$ by a marker and the area change during hydration and dehydration process is measured. The SME of the yarn and fabric are tested five times consecutively to evaluate the repeatability.

Water absorption level or percentage (%) described herein is identified as water-driven pore actuation behavior of a wool fabric due to SME. Images of back layer of the fabrics (attached to the body) at different water absorption percentages are taken using a light microscope and then pore area change % at different water absorption % are measured and compared by Image J software. Water absorption hereby can be calculated as follows:

$$\text{Water Absorption } \% = \frac{W}{D} \times 100$$

where W=Weight of absorbed water by the fabric; D=Weight of dried fabric

"Thermoregulation" described herein can be determined as the heat regulation and dissipation rate of the water-driven pore-actuating knitwear prepared according to various embodiment of the present invention under different water gradients and compared with respect to air permeability thermal conductivity, water vapor transmission and radiative heat loss.

For air permeability and thermal conductivity, 0, 25, 50, 75 and 100% of water absorption are considered and examined five times for average values. However, during thermal conductivity measurement, the water absorption usually initiates from 5% instead of absolute 0% because at 0% (completely dried state) water absorption the samples are completely oven dried and are shown to have high surface temperature, which can directly affect the results of the thermal conductivity. Hence, oven dried fabrics are kept in a sealed desiccator with silica gel until the fabrics surface temperature become equilibrium. Moreover, the air permeability is thereby measured by an SDL instrument at a pressure of 25 Pa using a head area of 1 cm2. Thermal conductivity (k) is studied using a KES-F Thermo Labo. Water vapor transmission rate (WVTR) of the fabrics is conducted according to ASTM E96-80B. The test is done under different environmental temperatures (20, 25, 30, 35 and 40° C.) at constant humidity of 80% RH and different relative humidity values (20, 40, 60 and 80%) at constant temperature of 25° C.

For measuring radiative heat loss, oven dried and 100% of water absorption ae considered. Thermal images are obtained for IR characterization using an IR camera (FLIR A655sc). Briefly, in order to provide uniform thermal radiation and mimic the human body temperature, a chamber with a guard hot plate with a constant temperature of 300C is used and the thermal camera is placed in an air space with a constant angle and distance from the hot plate. Finally, when the specimen is placed on the hot plate, pictures are taken every 5 seconds until the heat transfer reaches equilibrium. Temperature of the surface is calculated using FLIR Tools software in which each pixel of the picture is allocated to one temperature value. The average is subsequently created based on all values. Furthermore, to obtain a numerical value of IR transmission % through the fabric in dry and wet states, an ATR-FTIR spectroscopy (The Bruker Veertex-70) is used.

DETAILED DESCRIPTION OF THE INVENTION

In the following description, the animal fiber, fabric, textile and methods for preparing thereof and the likes are set forth as preferred examples. It will be apparent to those skilled in the art that modifications, including additions and/or substitutions may be made without departing from the scope and spirit of the invention. Specific details may be omitted so as not to obscure the invention; however, the disclosure is written to enable one skilled in the art to practice the teachings herein without undue experimentation.

It should be apparent to practitioner skilled in the art that the foregoing examples of the system and method are only for the purposes of illustration of working principle of the present invention. It is not intended to be exhaustive or to limit the invention to the precise forms disclosed.

Figure 2A:
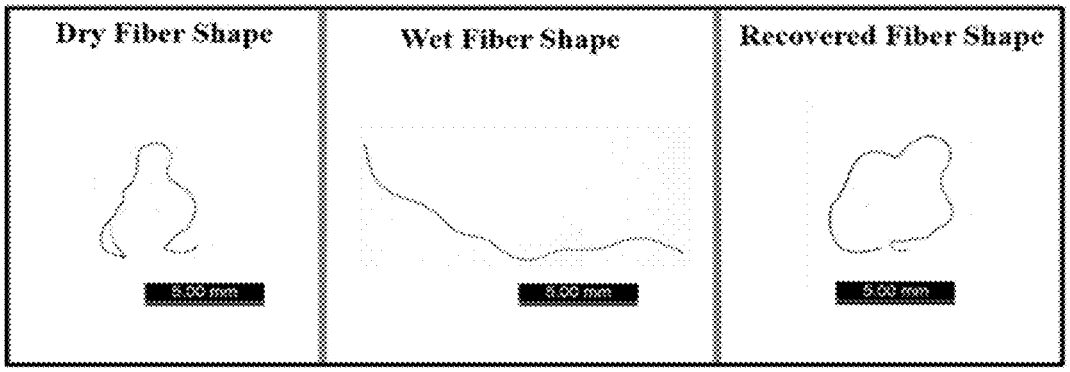
FIG. 2A shows morphological changes in the water-responsive shape memory fiber of the present invention before and after water exposure followed by recovery under light microscopy.
Figure 2B:
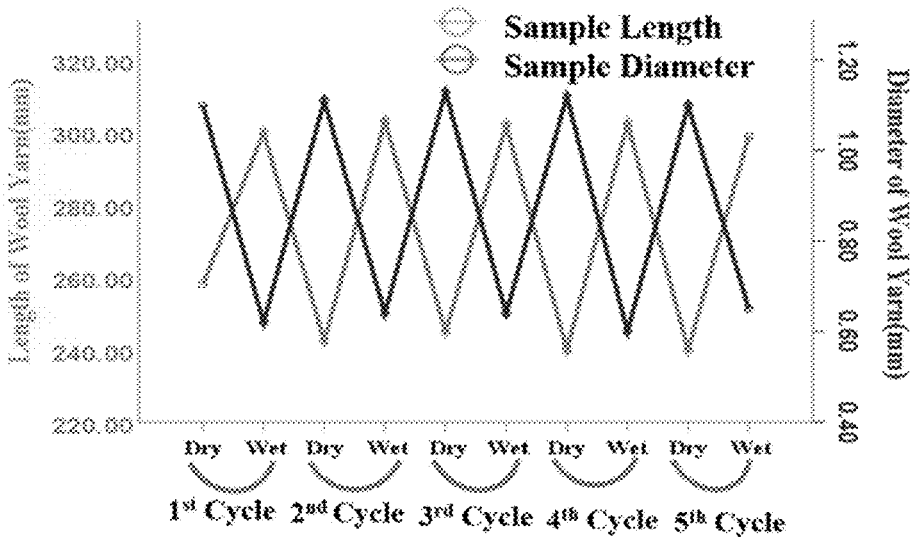
FIG. 2B shows changes in length and diameter of the yarn prepared according to an embodiment of the present invention being exposed to wet-and-dry cycles.
Figure 2C:
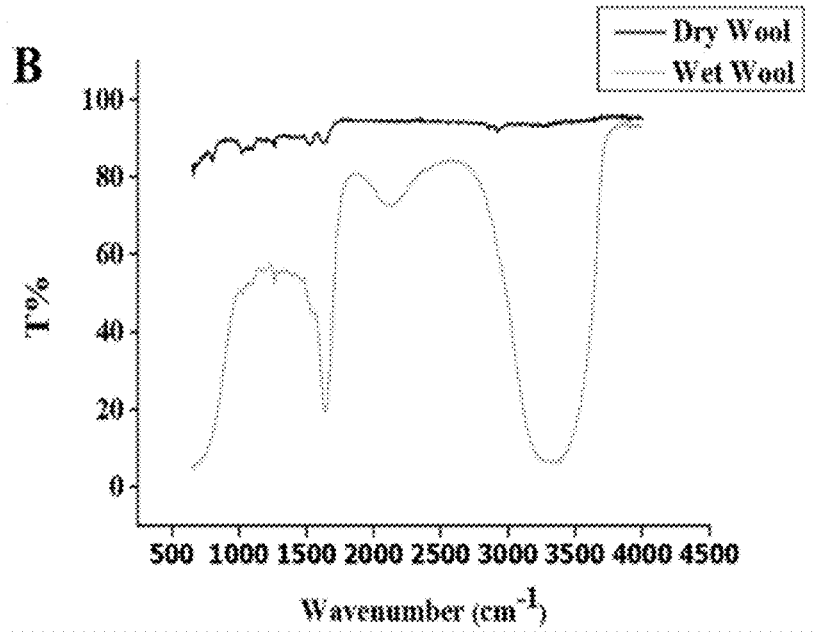
FIG. 2C shows changes in tensile strength of the yarn prepared according to an embodiment of the present invention in wet and dry states under FTIR characterization.
Figure 2D:
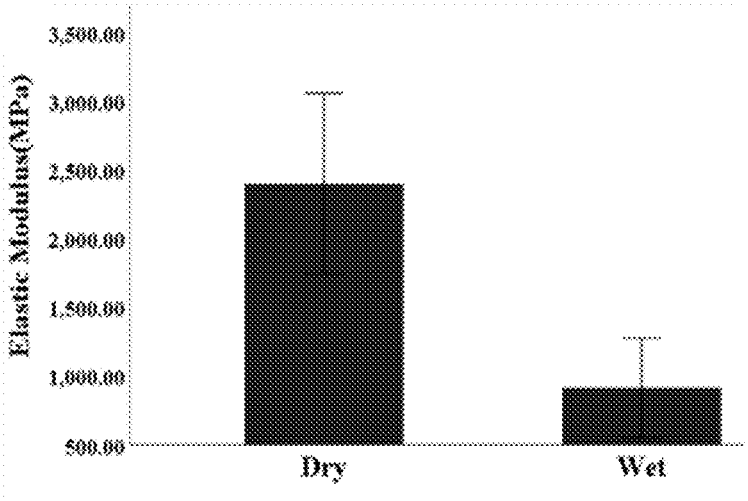
FIG. 2D illustrates elastic modulus of the present animal fiber according to an embodiment of the present invention in wet and dry states.

Example 1—Preparation of raw wool fiber with water-responsive shape memory effect:

The scaled raw fibers are treated in an ultrasonic bath (35 KHz, 40 W) containing sodium hypochlorite (5 g/l), hydrochloric acid (1 g/l), and nano-calcium carbonate (10 g/l) at 37° C. for 45 min. When the fiber is exposed to water and air, it can show shape memory effect with over 90% shape fixity and recovery ratio (FIG. 2A). FIG. 2B shows that the yarn prepared by twisting the processed fibers in a specific spinning frequency has shape memory effect (SME) evident by the varying yarn length and diameter during five consecutive wet-and-dry cycles. FIG. 2C shows that the present yarn in wet state has a much higher absorption intensity than the yarn in dry state, in particular within the ranges of 3050-3650 $cm^{-1}$ and 1250-1850 $cm^{-1}$, respectively. Comparison of elastic modulus between dry and wet states of the present fiber in FIG. 2D further verifies that the addition of water in the dry fiber leads to expansion of its molecular chain, resulting in straightening of the fiber. It is evident by a lower tensile modulus obtained at its wet state than that obtained at its dry state. It is due to the effect of the added water on higher molecular vibration along the chain of the fiber. These results demonstrate the gain of the shape memory behavior of the yarn prepared from the fiber according to the present invention which provide responses to hydration and dehydration. As compared to the prior arts which the fiber behavior is just one-way (i.e., only responsive to a change in water content but is not self-recoverable upon drying), the shape memory behavior of the present fiber and yarn prepared therefrom are two-way (i.e., enables self-recovery after the fiber/yarn is exposed to drying).

Figure 3:
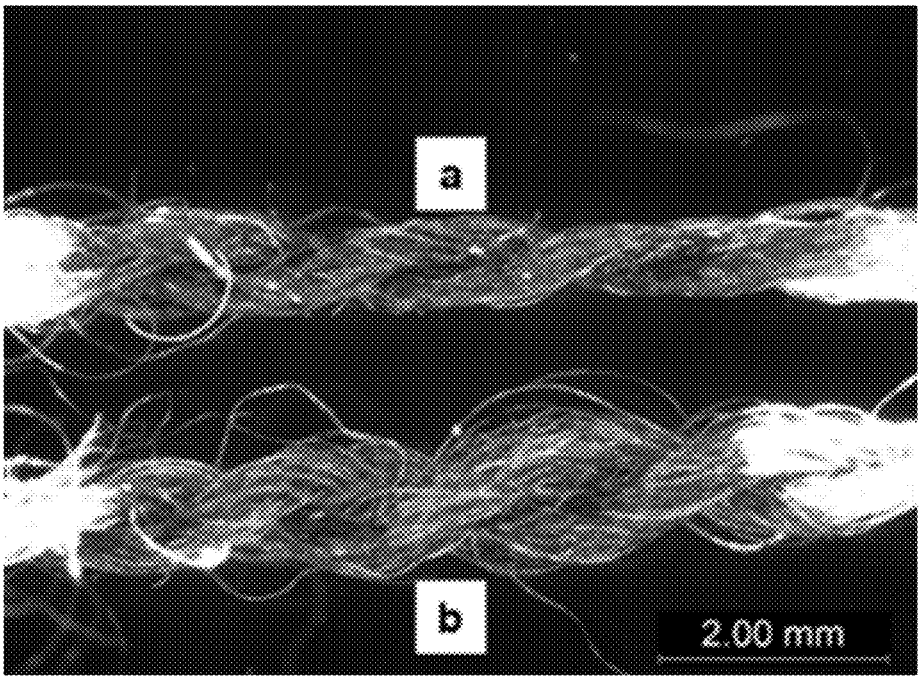
FIG. 3 shows the changes in morphology of a water-responsive shape memory yarn prepared according to the present invention before and after water exposure under microscopy.

Example 2—Water-responsive shape memory effect of double-stranded yarn:

In this example, the wool fibers from which the surface and scales have been removed are spun by combing and ring spinning, with a twist of 280 twists per meter. The two single yarns obtained are combined with a twist of 500 twists per meter. The resulting double-stranded yarn is steam treated for 30 minutes to obtain a yarn with water-responsive shape memory effect. When the yarn is exposed to water, the length increases by about 20%, and the thickness decreases by about 40% (FIG. 3). When the water is eliminated upon drying, its structure can gradually return to its original shape.

Figure 11:
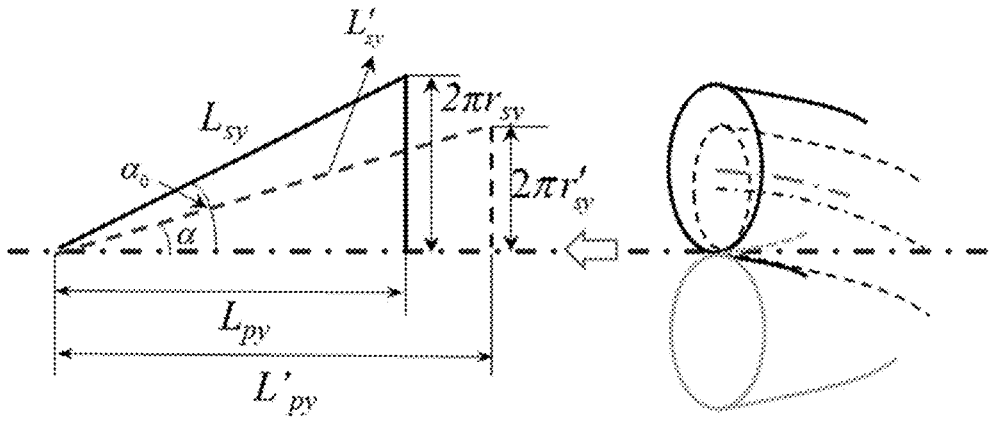
FIG. 11 schematically depicts how diameter of a single yarn prepared according to an embodiment of the present invention is changed.

FIG. 11 illustrates the relationship between the yarn diameter and the curvature and torsion of the fibers. In FIG. 11, $r_f$ denotes the radius of spin of the fiber in a single yarn; $l_f$ denotes the length of the fiber and the corresponding yarn length in a turn of the fiber is $L_{sy}$; s denotes the arc length from ($r_f$, 0, 0) to arbitrary point S. By ignoring the migration of fibers in the yarn's radial direction, the helical locus of the fiber in the yarn can be expressed as $$S(s) = \left\{ r_f \cos\left(\frac{2\pi}{l_f}s\right),\ r_f \sin\left(\frac{2\pi}{l_f}s\right),\ \frac{L_{sy}}{l_f}s \right\} \tag{1}$$

Using the equation (1), the curvature κ and the torsion τ of the fiber in the single yarn are respectively expressed in equations (2) and (3), as follows:

$$\kappa = \lim_{\Delta s \to 0}\left|\frac{\Delta\varphi}{\Delta s}\right| = \frac{|S'(s) \times S''(s)|}{|S'(s)|^3} \tag{2}$$

$$\tau = \lim_{\Delta s \to 0}\left|\frac{\Delta\psi}{\Delta s}\right| = \frac{(S'(s), S''(s), S'''(s))}{|S'(s) \times S''(s)|^2} \tag{3}$$

Substituting equations (1) into equation (2) and equation (3), equations (4) and (5) are obtained as follows:

$$\kappa = \frac{4\pi^2 r_f}{l_f} \tag{4}$$

$$\tau = \frac{2\pi L_{sy}}{l_f^2} \tag{5}$$

By rearranging the equations (4) and (5), the corresponding yarn radius and length can be determined by:

$$r_f = A\kappa,\ A = \frac{l_f}{4\pi^2} \tag{6}$$

$$L_{sy} = B\tau\ \ B = \frac{l_f^2}{2\pi} \tag{7}$$

Based on the ideal packing form of yarns, the diameter $d_{sy}$ of the single yarn can be expressed as:

$$d_{sy}=2\cdot\max\{r_f\}=2\cdot\max\{A\kappa\} \tag{8}$$

On the basis of the analysis, it can be seen from equations (7) and (8) that the length $L_{sy}$ and diameter $d_{sy}$ of single yarns are determined by the curvature and torsion of fibers. Physically, the diameter of single yarns reduces when the fibers straighten after wetting; while the length of single yarns increases with the extending of fibers along the axial direction of the yarn when they are in wet state.

Figure 4:
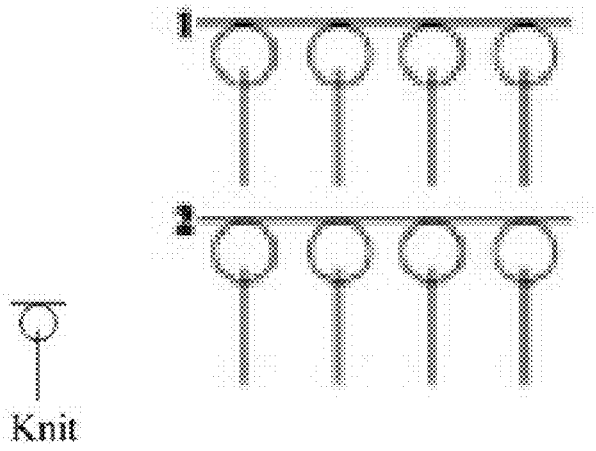
FIG. 4 schematically depicts a knitting pattern according to an embodiment of the present invention.
Figure 5A:
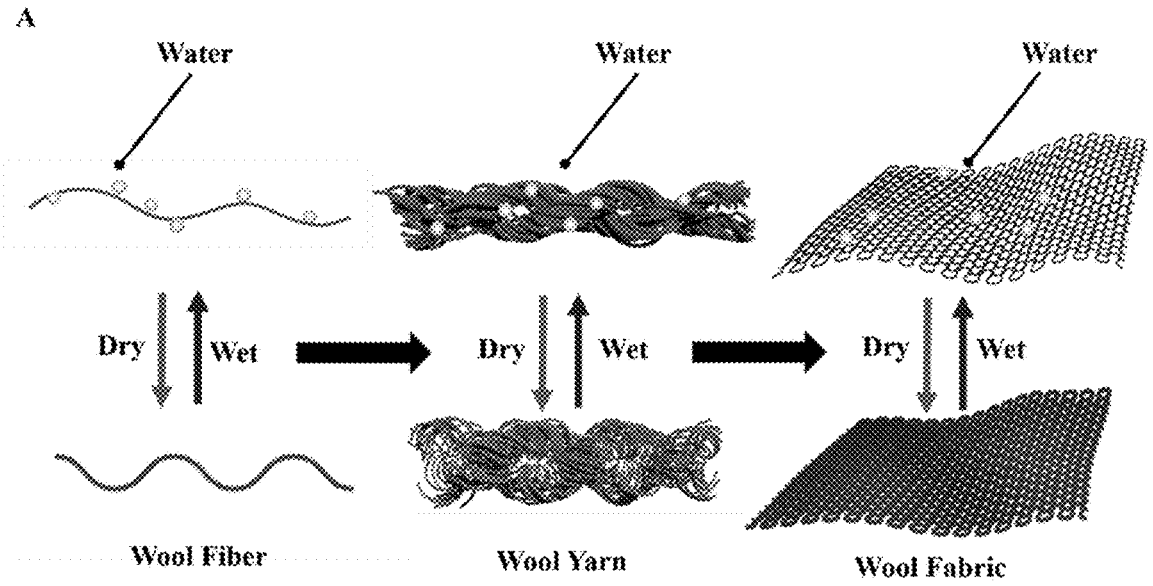
FIG. 5A schematically depicts pore actuation function of the present fiber, yarn and fabric prepared according to various embodiments of the present invention in wet and dry states.
Figure 5B:
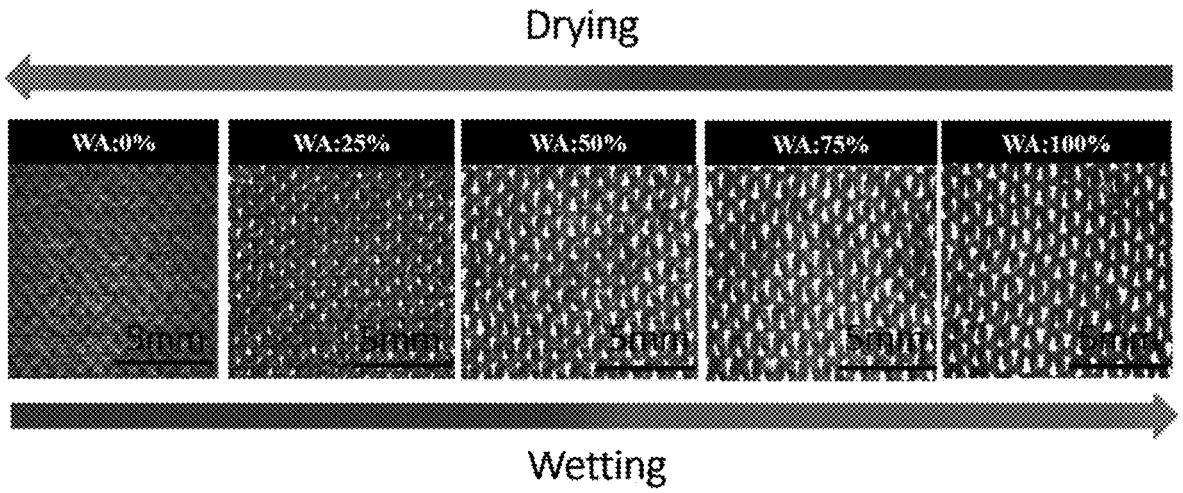
FIG. 5B shows a series of images depicting the morphological change of the present fabric exposed to different content of water according to an embodiment of the present invention.
Figure 5C:
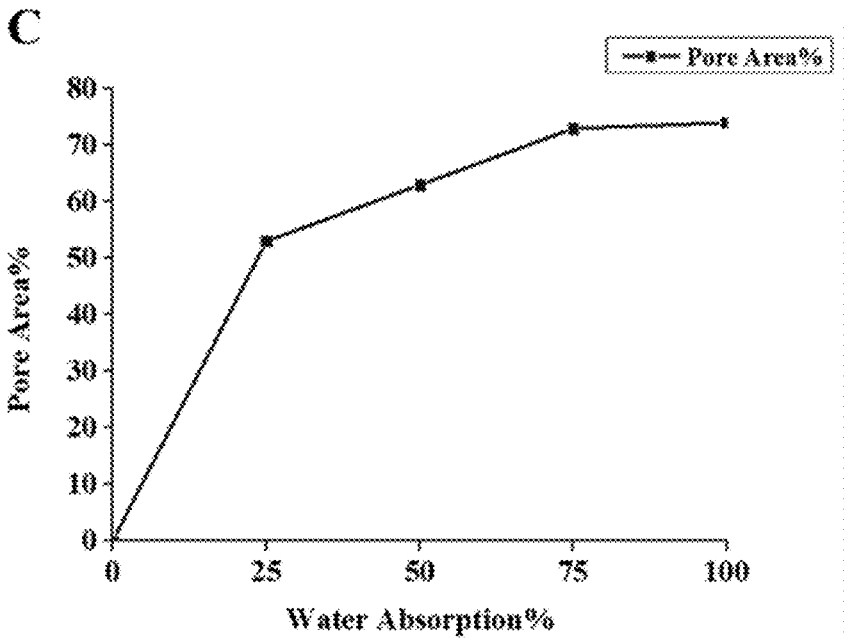
FIG. 5C shows pore area changes in the present fabric prepared according to an embodiment of the present invention.
Figure 12:
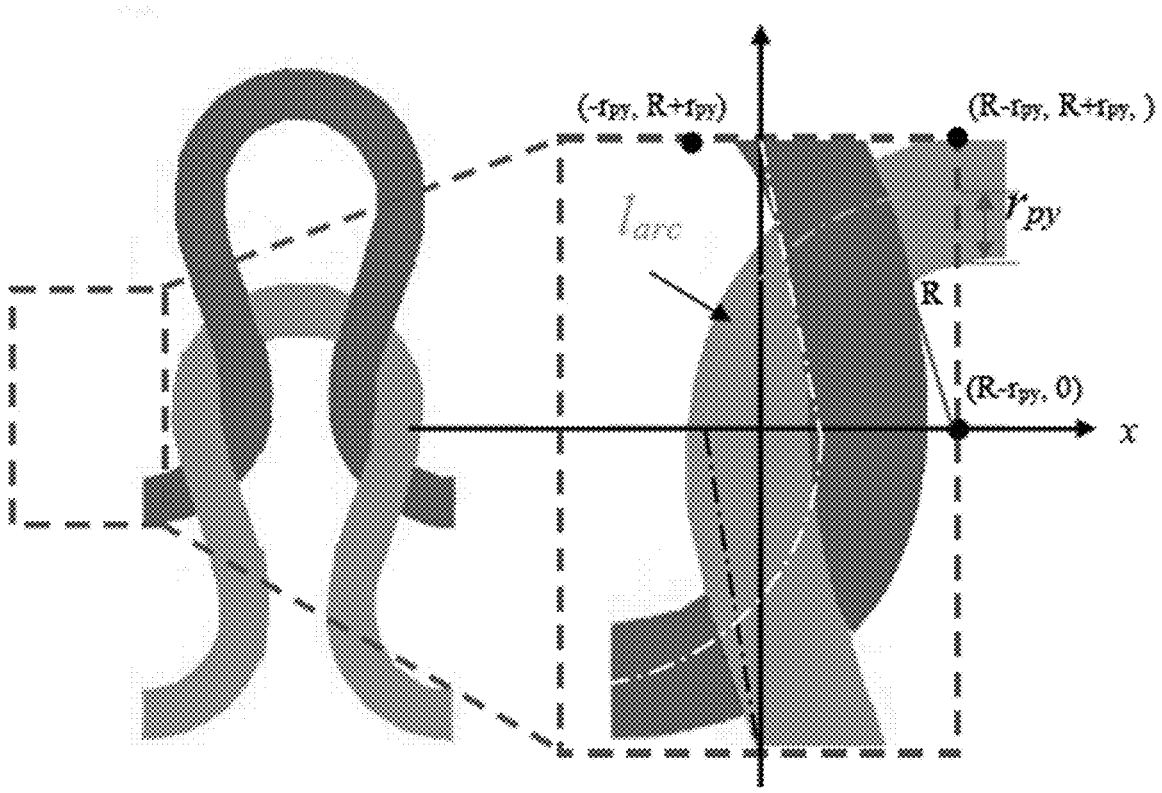
FIG. 12 schematically depicts knitted structure and a unit of the knitted fabric prepared according to an embodiment of the present invention.

Example 3—Shape memory wool fabric with knit pore actuation function and other thermoregulation-related properties:

The double-stranded wool yarn with water-responsive shape memory effect from Example 2 is fabricated on an automatic flat knitting machine with twelve needles per inch, and according to the knitting pattern as shown in FIG. 4 to obtain a shape memory wool fabric with a specific temperature adjustment and pore actuation function (FIGS. 5A and 5B). Similar to the variation of diameter and length of the present yarns according to the change in curvature and torsion of the fibers, FIG. 12 illustrates how the wool fabric knitted according to the pattern as shown in FIG. 4 responds to the changes in water content by changing the diameter and length of a single yarn. It is observed from FIG. 5B that when the plied yarn absorbs water, the diameter of the single yarn becomes smaller due to unbending deformation of internal fibers of the plied yarns. As shown in FIG. 5B and FIG. 5C, the woven, water-vapor permeable, water-responsive, shape-memory wool fabric has a pore area percentage that reversibly increases from zero percent pore area at zero percent fabric water absorption to approximately 70% pore area at approximately 75 percent fabric water absorption. From the geometry perspective, the length changes of the plied yarn can be derived from:

$$L_{sy}^2=L_{py}^2+(2\pi r_{sy})^2 \tag{9}$$

Differential equation (9) by $L_{sy}$, equation (10) is obtained:

$$\frac{dL_{sy}}{L_{sy}}=\frac{L_{py}^2}{L_{sy}^2}\frac{dL_{py}}{L_{py}}+\frac{(2\pi r_{sy})^2}{L_{sy}^2}\frac{d(2\pi r_{sy})}{2\pi r_{sy}} \tag{10}$$

Assuming the strain of length of the single yarn as $\varepsilon_{isy}$; the strain of diameter of single yarn as $\varepsilon_{rsy}$; and the strain of length of plied yarn as $\varepsilon_{ipy}$:

$$\varepsilon_{lsy}=\frac{L_{py}^2}{L_{sy}^2}\varepsilon_{lpy}+\frac{(2\pi r_{sy})}{L_{sy}^2}\varepsilon_{rsy} \tag{11}$$

then $$\varepsilon_{lpy}=\frac{\varepsilon_{lsy}-\sin^2\alpha_0\varepsilon_{rsy}}{\cos^2\alpha_0} \tag{12}$$

Based on equation (12), the length of the plied yarn changes with the length of each single yarn. For example, the length of plied yarn increases when the diameter of single yarn decreases.

The loop distance of the adjacent knitted loops along wale and course directions can be respectively derived from equations (13) and (14), respectively:

$$D_A=4(R-r_{py})=\frac{2}{\pi}l_{arc}-4r_{py} \tag{13}$$

$$D_B=2(R+r_{py})=\frac{1}{\pi}l_{arc}+2r_{py} \tag{14}$$

wherein $l_{arc}$ denotes the length of arc in the loop as shown in FIG. 12.

From equation (13), the loop distance in wale direction of the knitted fabric becomes large when the length of loop increases and the diameter of plied yarns decrease. It can be also induced that the dimension changes of wale direction are larger than those of course direction with an increasing $l_{arc}$ and decreasing $r_{py}$ by comparing the equations (13) and equation (14), which is consistent with the corresponding measurements described herein.

FIG. 5C shows pore size adjustment property of the present knitwear against different water absorption levels, indicating pore opening/closing (or actuation) mechanism responsive to the change in water content in the yarn.

Porosity of the knitted fabrics can be expressed as:

$$\zeta=1-\frac{V_{p-yarn}}{V_{Fabric}}=1-\frac{\pi l_{loop}r^2}{D_A D_B t} \tag{15}$$

wherein $l_{loop}$ denotes the length of a whole knitted loop in a unit.

Assuming the $t\approx 2.5d=5r_{py}$ and $l_{loop}\approx 8R+4r_{py}$ for similarity:

$$\zeta=1-\frac{8\pi}{5\delta-60/\delta-20},\ \delta=\frac{l_{loop}}{d_{py}} \tag{16}$$

wherein δ denotes the linear modulus of stitch for knitted fabrics, which expresses the density of knitted fabrics.

Physically, it can be seen from equation (16) that the porosity of knitted fabric becomes big with increasing the loop length and reducing the diameter of plied yarn. It can also be seen that when the loop length increases and the diameter of the plied yarn decreases, the linear stitch modulus of the knitted fabric becomes larger, representing a loose structure. These explain why air permeability and thermal conductivity increase with the increase of the porosity of the knitted fabric, evidenced by the results shown in FIGS. 6, 7 and 8A.

Figure 5D:
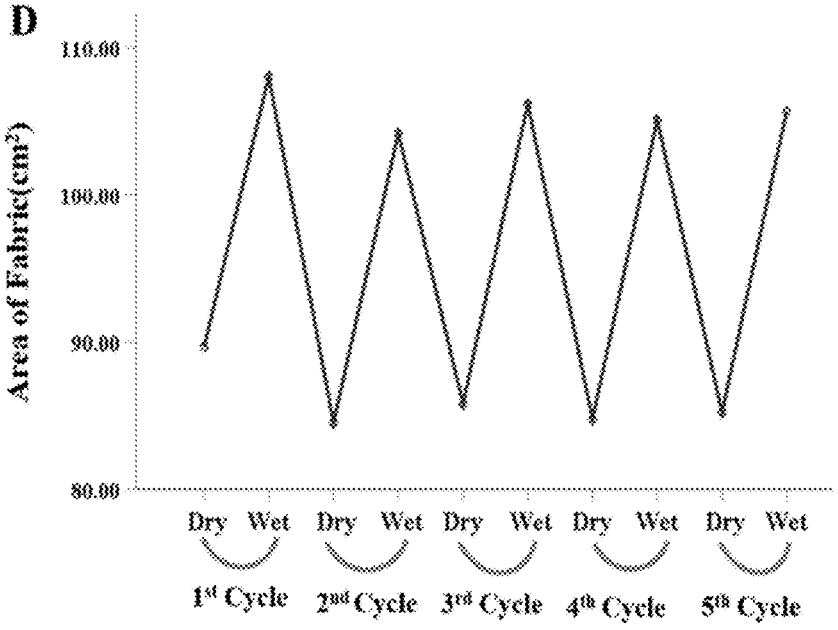
FIG. 5D shows changes in a reversible area change in the present fabric during five consecutive wet-and-dry cycles.

FIG. 5D further shows that the surface area of the knitwear is increased when being exposed to water, while it is able to recover to its initial state when the water is eliminated from the yarns of the knitwear.

Figure 6:
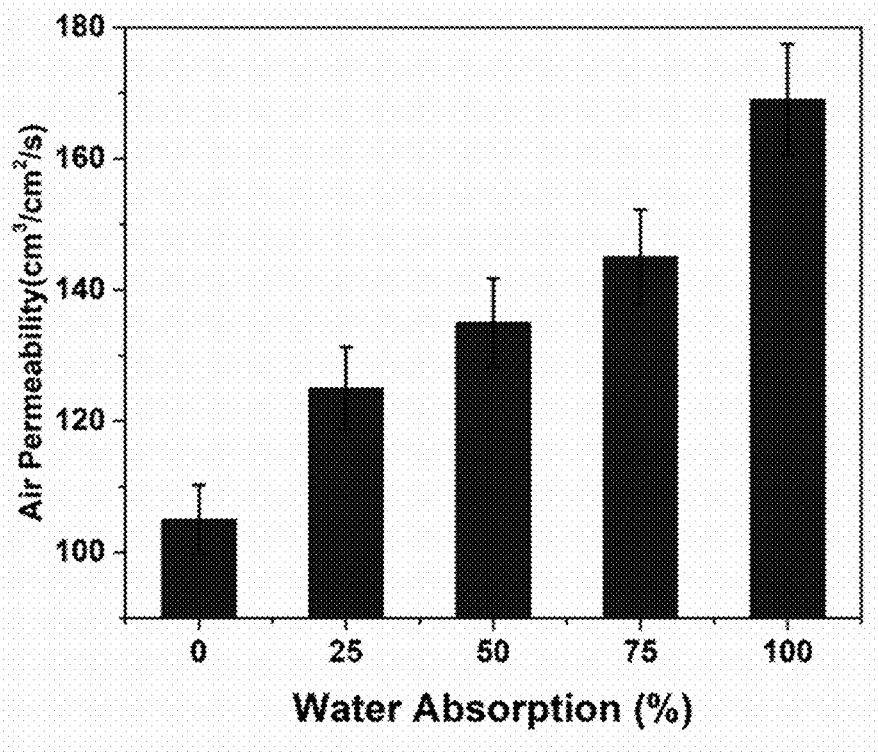
FIG. 6 shows the changes in air permeability against different degrees of water absorption by the fabric prepared according to an embodiment of the present invention.
Figure 7:
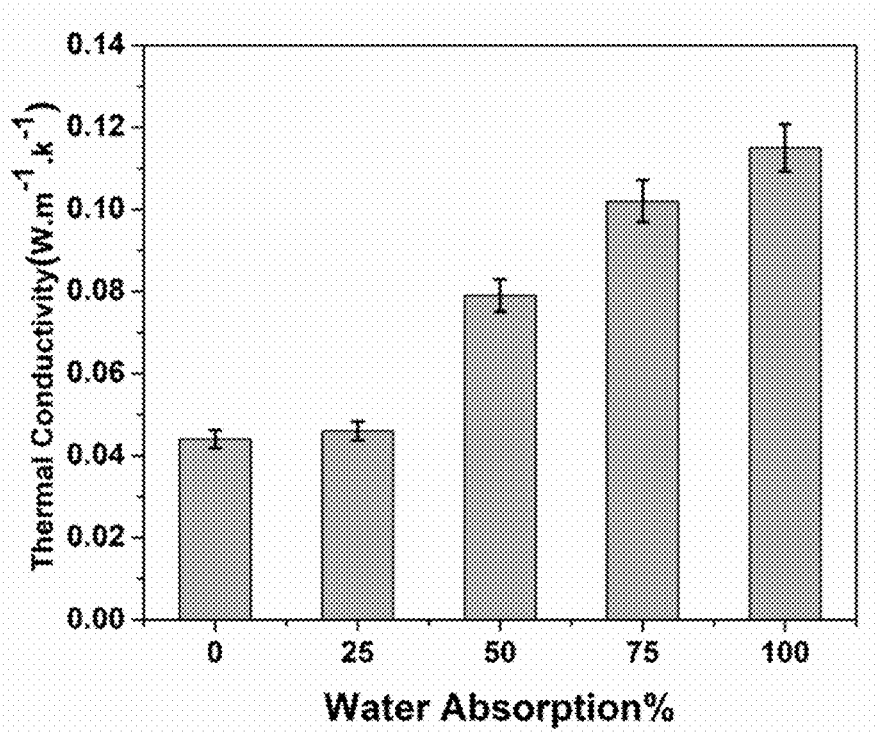
FIG. 7 shows the changes in thermal conductivity of the present yarn against different degrees of water absorption by the fabric prepared according to an embodiment of the present invention.
Figure 8A:
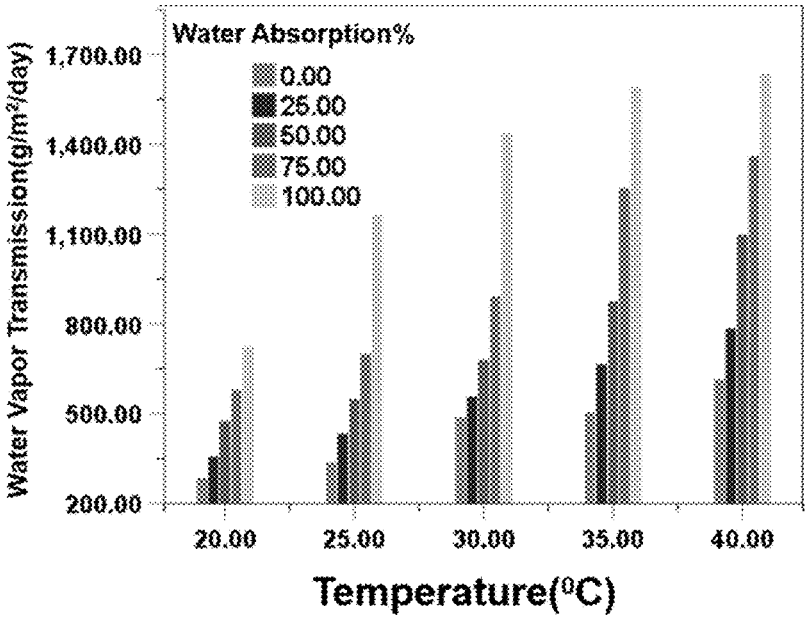
FIG. 8A shows the effect of temperature on water vapor transmission against different degrees of absorption by the fabric prepared according to an embodiment of the present invention.

FIGS. 6, 7 and 8A show that air permeability, thermal conductivity, and water vapor transmission of the knitwear are increased by about 60%, 67%, and 65%, respectively, when the water absorption level is increased from about 0% to about 100%. The air permeability increases when the water content in the knitwear increases mostly due to structural changes in the yarns (evidenced by the varying yarn length and diameter during wet-and-dry cycles in FIG. 2B) and the subsequent pore opening/closing function responsive to water content changes (evidenced by FIG. 5C).

Figure 8B:
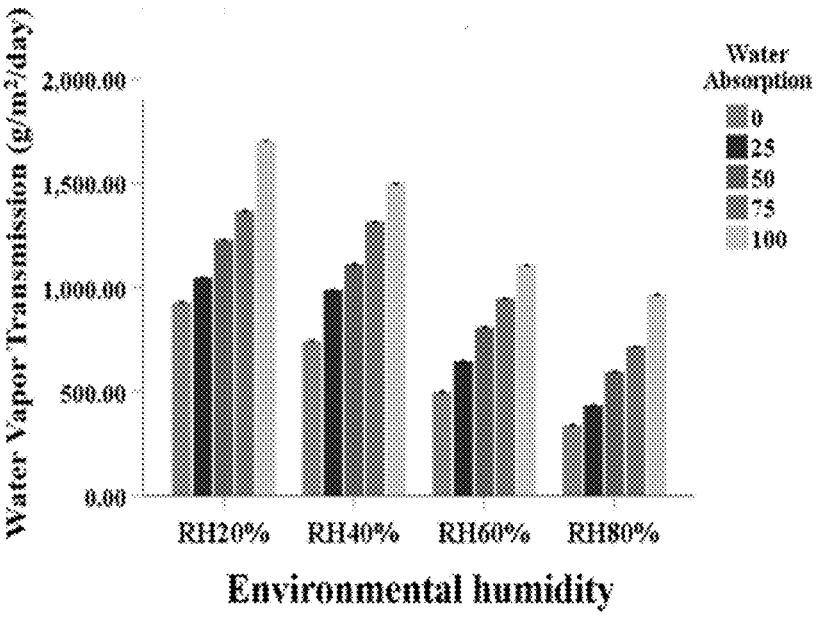
FIG. 8B shows the effect of environmental humidity (RH) on water vapor transmission against different degrees of absorption by the fabric prepared according to an embodiment of the present invention.

FIG. 8B further shows that the present knitwear prepared by the present yarns transmits the moisture (sweat) from the human body to the surroundings. Even at high environmental humidity (i.e., about 80% R.H. in this example), the present knitwear still has water vapor transmission function, although the transmission rate is relatively lower at higher relative humidity.

Overall, the knitwear exerts higher water vapor transmission rate at higher water absorption under different temperatures; the water vapor transmission rate also increases with an increase in water gradient at different levels of relative humidity, but at higher relative humidity the transmission rate is lower than that measured at lower relative humidity. The maximum water vapor transmission efficiency of the knitwear is to be at higher temperature and lower humidity. From these results, the present invention is shown to have high potential to be developed into an all-condition water-responsive textile such as woolen knitwear as in the examples described herein.

Figure 9A:
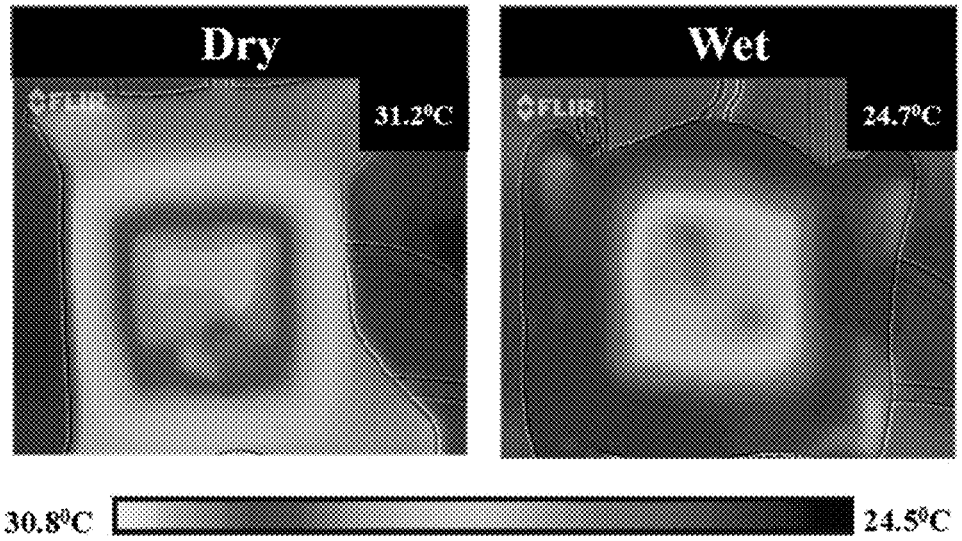
FIG. 9A shows the difference in heat transfer of the fabric in wet and dry states from surface IR images according to an embodiment of the present invention.
Figure 9B:
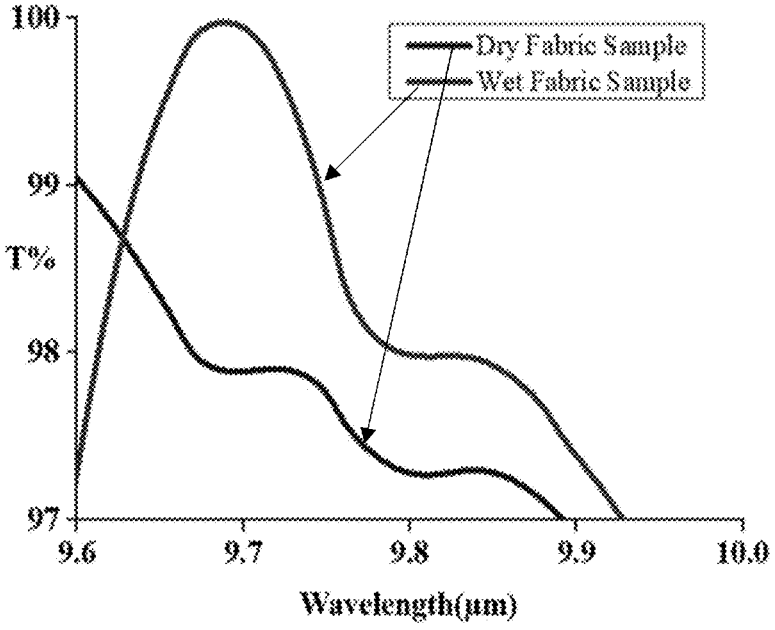
FIG. 9B shows IR transmittance change (T %) of the present fabric prepared according to an embodiment of the present invention.

FIGS. 9A-9B show that the surface temperature of the knitwear is reduced by about 20% at wet state compared to its dry state. The detected temperatures in FIG. 9A from the knitwear in dry and wet states are 31.16° C. and 24.72° C. respectively, indicating that wet knitwear exhibits a radiative cooling. ATR FTIR transmittance of the knitwear is measured within a range of 9.5-10 μm because the human body absorbs and loses heat largely (>40%) through infrared radiation centering around 10 μm. FIG. 9B shows a clear trend of increasing infrared transmission of the wet knitwear from 9.65-9.95 μm compared to dry knitwear, resulting in a radiative cooling of the wearer's skin due to loop shape difference in dry and wet state of the wool fabrics (as shown in FIG. 5B).

Figure 10:
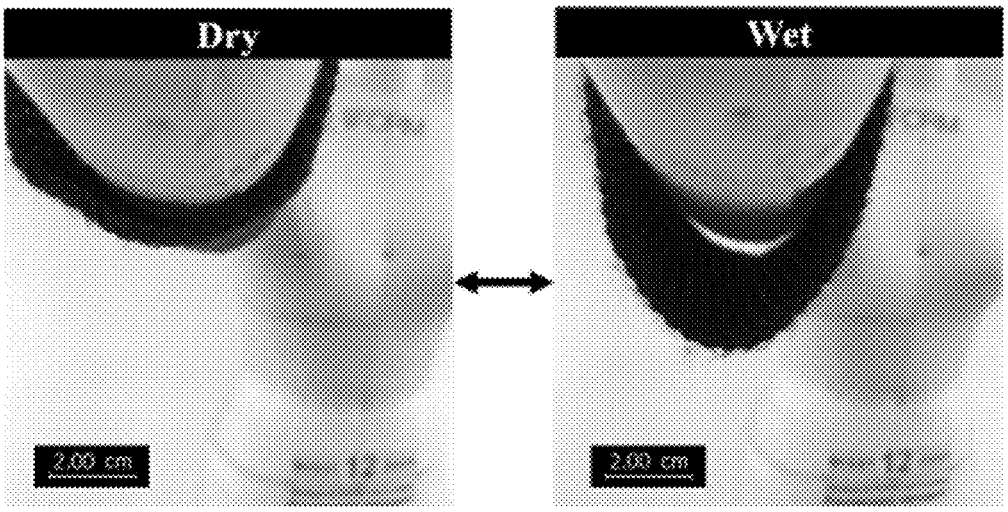
FIG. 10 shows adaptive ventilation effect of the fabric prepared according to an embodiment of the present invention.

FIG. 10 also shows that the knitwear prepared by the present yarns can also provide adaptive ventilation effect with an increase in water absorption.

The foregoing description of the present invention has been provided for the purposes of illustration and description. It is not intended to be exhaustive or to limit the invention to the precise forms disclosed. Many modifications and variations will be apparent to the practitioner skilled in the art.

The embodiments were chosen and described in order to best explain the principles of the invention and its practical application, thereby enabling others skilled in the art to understand the invention for various embodiments and with various modifications that are suited to the particular use contemplated.

INDUSTRIAL APPLICABILITY

The present invention has a potential to be applied and developed into a garment textile with dynamic pore openings and adaptive air trap-ability that can provide thermoregulation. The water gradient pore actuation ability of the knitwear due to shape memory effect, opens up the new horizon for rediscovering woolen apparel as potential personal thermal management textiles. Hence, by using the present method to prepare wool fabrics, sustainable thermoregulatory textiles including socks and different parts of a garment can be fabricated.

The invention claimed is:

1. A knit, water-vapor permeable, water-responsive, shape-memory wool fabric comprising:

a plurality of descaled wool fibers twisted into single yarns at a twisting density of 100 to 600 twists per meter of fibers; and multi-ply yarns formed from the single yarns and having a twisting frequency of 200 to 700 twists per meter of the single yarns, the multi-ply yarns being steam set to form shape-memory multi-ply yarns;

wherein the shape-memory multi-ply yarns being formed into a first knitting pattern including dynamic pore openings reversibly responsive to an absorbed fabric water content, such that the knit, water-vapor permeable, water-responsive, shape-memory wool fabric has a pore area percentage that reversibly increases from zero percent pore area at zero percent fabric water absorption to approximately 70% pore area at approximately 75 percent fabric water absorption.

2. The wool fabric of claim 1, wherein the multi-ply yarns are between two and five single yarns at the first twisting frequency of 200 to 400 twists per meter of the single yarns.

3. The wool fabric of claim 1, wherein the multi-ply yarns are processed by chlorination in an ultrasonic bath.

4. The wool fabric of claim 3, wherein the ultrasonic bath contains a chlorination solution comprising sodium hypochlorite, hydrochloric acid, and nano-calcium carbonate; the ultrasonic bath is set at an ultrasonic frequency and power of 35 KHz and 40 W, respectively, under a temperature of 37° C.

5. The wool fabric of claim 4, wherein the multi-ply yarns are immersed into the ultrasonic bath for about 45 minutes to remove surface scales from the multi-ply yarns.

6. The wool fabric of claim 3, wherein the multi-ply yarns after being processed by said chlorination are twisted at a second twisting frequency of 100 to 600 twists per meter of the single yarns.

7. The wool fabric of claim 6, wherein the multi-ply yarns are twisted by ring spinning either in a combed or carded manner.

8. The wool fabric of claim 6, wherein the second twisting frequency is from 200 to 400 twists per meter of the fibers.

9. The wool fabric of claim 1, wherein the multi-ply yarns, the plurality of descaled wool fibers and fabric knitted therefrom are biodegradable.

10. A method for preparing a knit, water-vapor permeable, water-responsive, shape-memory wool fabric, comprising:

descaling surface scales of a plurality of wool fibers by chlorination under ultrasound to form the plurality of descaled wool fibers;

combing or carding the plurality of descaled wool fibers after said descaling;

twisting the plurality of descaled wool fibers at a twisting frequency of 100 to 600 twists per meter of the fibers to yield the single yarns;

twisting the single yarns at a twisting frequency of 200 to 700 twists per meter of the single yarns to yield the multi-ply yarns;

setting the multi-ply yarns by steaming followed by drying to form the shape-memory multi-ply yarns;

forming a first knitting pattern into the shape-memory multi-ply yarns to obtain a knit, water-vapor permeable, water-responsive, shape-memory wool fabric, wherein the first knitting pattern including dynamic pore openings reversibly responsive to an absorbed fabric water content, such that the knit, water-vapor permeable, water-responsive, shape-memory wool fabric has a pore area percentage that reversibly increases from zero percent pore area at zero percent fabric water absorption to approximately 70% pore area at approximately 75 percent fabric water absorption.

11. The method of claim 10, wherein the multi-ply yarns are twisted by ring spinning at 200 to 400 twists per meter after said combining or carding.

12. The method of claim 10, wherein the multi-ply yarns are between two to five single yarns at a twisting frequency of 400 to 600 twists per meter.

13. The method of claim 10, wherein the setting of the multi-ply yarns by steaming is for about 10 to 90 minutes following by said drying at about 105° C. for about 10 to 90 minutes in an oven.

14. A textile made of a wool fabric prepared according to the method of claim 10.

* * * * *